US005898751A

United States Patent [19]

Yakoby et al.

[11] Patent Number: 5,898,751

[45] Date of Patent: Apr. 27, 1999

[54] ELECTRONIC TENNIS ANALYZER

[76] Inventors: Solomon Yakoby, 108-50 62nd Dr. (4B), Forest Hills, N.Y. 11375-1248; Chad Walner, 80 Westwood Dr. (206), Westbury, N.Y. 11590

[21] Appl. No.: 08/862,565

[22] Filed: May 23, 1997

[51] Int. Cl.[6] ..... A63B 71/00

[52] U.S. Cl. ..... 377/5; 377/13

[58] Field of Search ..... 377/5, 13

[56] References Cited

U.S. PATENT DOCUMENTS

| | | | |
|---|---|---|---|
| 3,730,131 | 5/1973 | Izzo . | |
| 4,097,855 | 6/1978 | Salvo . | |
| 4,237,372 | 12/1980 | Zevgolis et al. | 235/92 GA |
| 4,491,954 | 1/1985 | Genuit | 377/5 |
| 4,700,369 | 10/1987 | Siegal et al. | 377/5 |
| 5,084,695 | 1/1992 | Freeman | 377/5 |
| 5,134,565 | 7/1992 | Herbertz | 364/411 |
| 5,574,422 | 11/1996 | Martin | 377/5 |

*Primary Examiner*—Margaret R. Wambach
*Attorney, Agent, or Firm*—Shenier & O'Connor

[57] ABSTRACT

An electronic scoring device for analyzing a player's tennis game. A group of push-buttons are used to increment corresponding counters to track statistics within six different categories. The categories may include aces, winners, unforced errors, other won points, double faults, forced errors and other lost points. The output of each counter is visually displayed along with a sum of the values contained in all the counters.

19 Claims, 2 Drawing Sheets

ELECTRONIC TENNIS ANALYZER

BACKGROUND OF THE INVENTION

1. Field of the Invention

The present invention relates to an electronic statistical recording device for tennis. More particularly, it relates to a device that analyzes a player's performance by tracking statistics within various categories of the game of tennis.

2. The Prior Art

In any competitive game, it is of great value to keep a reliable record of scores as the game progresses. In some games, particularly tennis, the scoring system is not as straightforward as simply counting a point score until a particular value is reached. In scoring tennis, the existence of a "deuce" or "advantage" condition may result in many alternating won and lost points until one of the players leads by two, concluding the game. A comprehensive solution to the needs of scoring a game such as tennis would necessarily involve a scoring device that may be small and light enough for the player to wear without discomfort or restriction of his playing skill.

In response to these needs, scoring devices have been developed for tennis which automatically identify the winning of a game and the subsequent increase in a player's set score. These devices, which also provide certain time-keeping functions, are disclosed in U.S. Pat. No. 4,237,372 and U.S. Pat. No. 5,134,565. However, certain drawbacks still exist because while these devices accurately monitor the score, they are not able to analyze the player's game behind the score. For example, conventional scoring following a "deuce" condition does not indicate if the ultimate loser won any points before surrendering the game. The tally of games for determining set or match winners does not reveal how competitive or how close the individual games were. These limitations in the scoring system will be inherent in any device that simply tracks conventional tennis scores.

Accordingly, it would be desirable to analyze a player's game by tracking the absolute number of points won (or lost), and the manner in which they were won (or lost), independent of the actual game score. Such a device would provide insight to the player's game by recording that numerous points were won in various categories. A losing player could still derive pleasure and positive reinforcement by pointing to the number of aces or winners he or she had during the match. Such a device would be invaluable during practice since it could keep track of specific strengths and weaknesses. Such tracking is virtually impossible with standard tennis scoring which treats all points generically.

SUMMARY OF THE INVENTION

It is therefore a primary object of our invention to provide a device for analyzing a player's tennis game to increase the player's enjoyment and skill.

It is a further object of our invention to provide a scoring device which tracks the absolute number of points won, or lost, in different categories.

It is yet another object of our present invention to provide a device capable of tracking points within the categories of aces, winners, unforced errors, other won points, double faults, forced errors, and other lost points.

Our device is preferably embodied in an electronic wrist-worn device similar in certain respects to an electronic wrist watch with an LCD display. The device includes six push-buttons mounted, for example, on the face of the watch, for tracking points within six different categories. The categories for won points may be selected from aces, winners, unforced errors and other won points. The categories for lost points may be selected from double faults, forced errors, unforced errors and other lost points. A player could track their won points in three categories and their lost points in another three categories. A player would be motivated to record these statistics for the purpose of identifying and improving their weakest abilities while being aware of their strengths.

Each of the push-buttons is coupled to a counter which is incremented by one upon actuation of the corresponding push-button. A clear button would allow the individual registers to be incremented down or cleared in the event that an incorrect entry had been made. The contents of each register is visually displayed, for example, adjacent the corresponding push-button. The content of the registers are also summed and visually displayed. The content of the counters may be stored to non-volatile memory or equivalent, for example, at the end of sets or matches. The stored data could be viewed or optionally downloaded into a computer for archiving and extensive statistical analysis.

BRIEF DESCRIPTION OF THE DRAWINGS

In the accompanying drawings to which reference is made in the instant specification which is to be read in conjunction therewith and in which like reference numerals are used to indicate like parts in the various views.

DESCRIPTION OF THE PREFERRED EMBODIMENT

Figure 1:
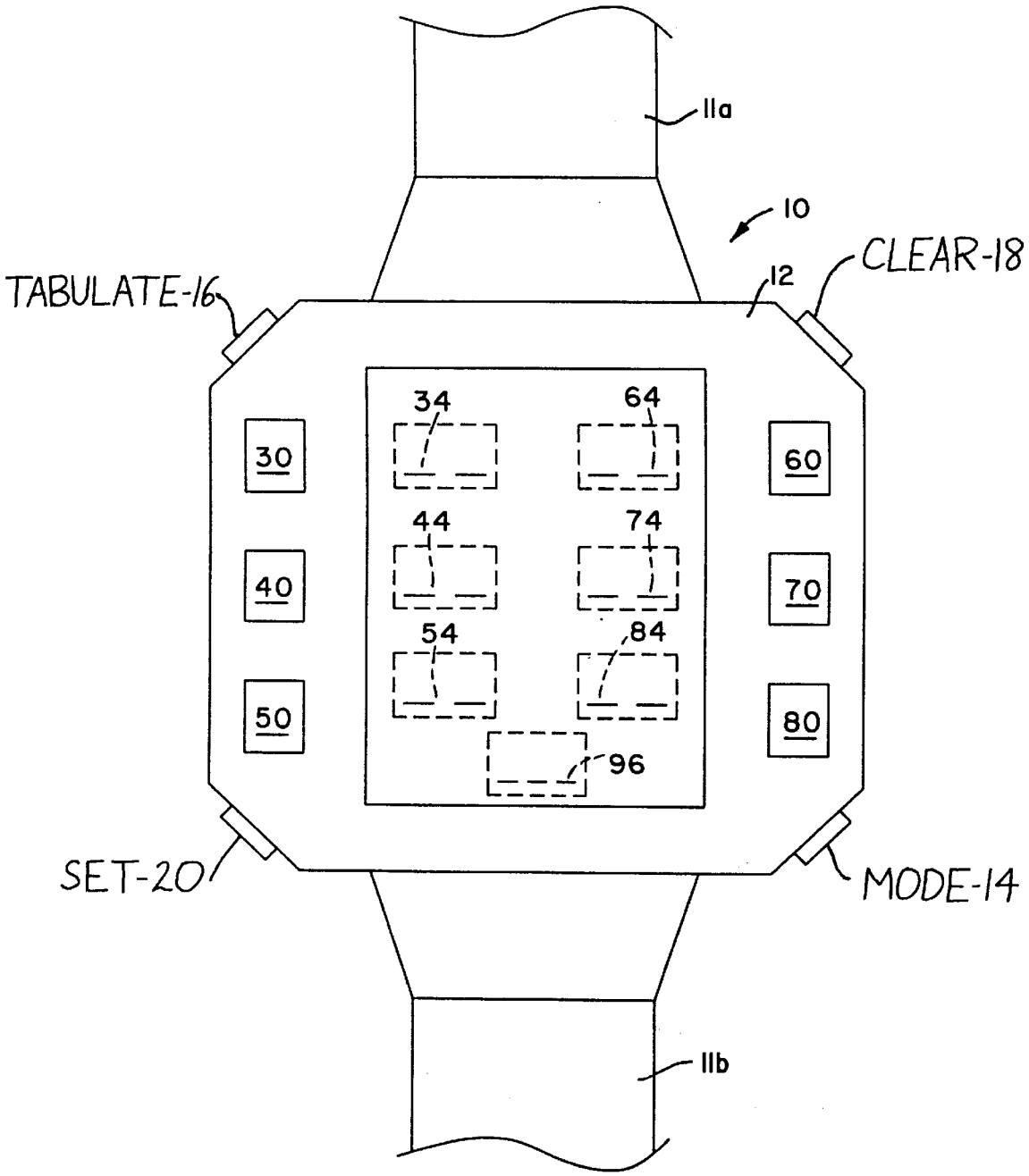
FIG. 1 is a front side elevational view of an electronic scoring device according to the invention showing the push-buttons and corresponding displays.

Referring to FIG. 1, there is shown an embodiment of an electronic scoring device 10 according to the invention encased within a housing 12 similar to a wristwatch and including watch bands 11*a* and 11*b* for securing housing 12 to an individual's wrist. The scoring device may alternately be embodied in a pocket watch or mounted to a tennis racquet. The sides of housing 12 include four push-buttons similar to push-buttons provided on conventional electronic watches. While a particular function will be herein assigned to these push-buttons, it should be understood that additional or different functions may be assigned without detracting from the purpose of the invention. Mode button 14 is for switching the device between a tennis analyzer or statistical tracking mode and other modes, for example, a clock mode, a stop watch mode, and an alarm mode. Tabulate button 16 may be used to display stored statistics. Clear button 18 is used to correct a mistaken entry, which will be described in greater detail below. Set button 20 is used to store the statistics that are being tracked by the device, for example, to a memory device to permit downloading to a computer at a later date.

On the face of housing 12, there are a set of push-buttons 30, 40, 50, 60, 70 and 80, which flank a central display area 22. Display area 22 includes display regions 34, 44, 54, 64, 74 and 84 which correspond electrically and by location to push-buttons 30, 40, 50, 60, 70 and 80, respectively. An additional display region 96 is also provided. Each push-button and corresponding display area track statistics in one of the categories. Display area 96, which displays three digits, then provides a running total for all six categories, each of which displays two digits, for example.

Figure 2:
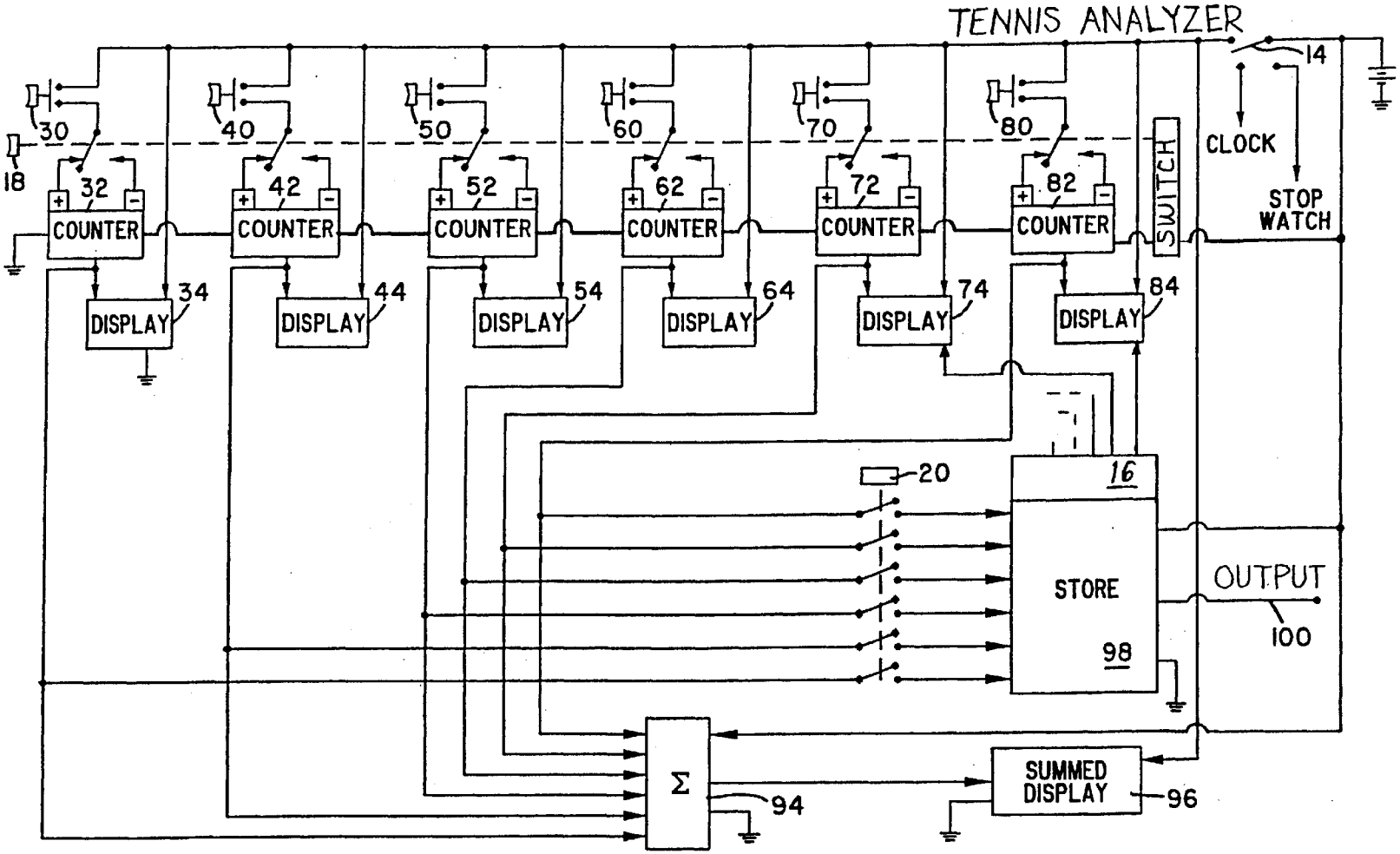
FIG. 2 is an electrical schematic diagram showing the circuitry of the invention.

Operation of the scoring device can be more clearly seen with reference to the schematic of FIG. 2. Mode button 14 switches operation of the device, as with many conventional electronic watches to select different watch function. Mode button 14 places the device into the tennis analyzer or statistical point tracking mode wherein displays 34, 44, 54, 64, 74, 84 and 96 are activated. Each push-button and display area pair includes a counter electrically coupled therebetween as indicated by reference numerals 32, 42, 52, 62, 72 and 82. While only counter 32 and display 34 are shown with a ground connection, it should be understood that all of the counters and all of the displays have a ground connection which has been omitted from the drawing for the sake of clarity. Initially, the counters are set to zero and the displays will indicate a zero or just remain blank. Depression of any one of the push-buttons 30, 40, 50, 60, 70 or 80, will send a pulse to the plus (+) terminal of the respective counter. Alternatively, a microphone and voice recognition system are employed to selectively pulse the counters. The revised contents of the counter are then indicated on the corresponding display. In one embodiment of the invention, each push-button, counter and display combination would track one category of either won or lost points.

In order to readily distinguish the categories from each other, the push-buttons may be color coded; the push-buttons can be labeled; or labels may be provided adjacent or within each of the display regions. The categories may be changed, translated into other languages, or user defined and additional categories may be added by providing additional push-button, counter and display combinations. For example, one of the six combinations or a seventh or other extra combination is assigned to track points lost on back-hand shots.

The output of each counter is indicated in the corresponding display, as described above. In addition, the counter outputs are combined in an adder 94 which then indicates the total of all counters in summed display 96. This represents the total number of points won, or lost, in each set, for example. Display 96 is also powered via mode switch 14. Furthermore, the outputs of the counters may be applied to a storage device 98 by depression of set button 20. It will be noted that storage device 98 has a constant power supply so that its contents will be retained regardless of the mode selected. Storage component 98 may consist of registers for accepting the six parallel inputs and loading the data into non-volatile memory An output line 100, for example, a jack, will allow the contents of storage device 98 to be downloaded into a computer for archiving or historical statistical analysis.

Stored data can be retrieved enabling a player to see the statistics from previous sets. Storage device 98 includes connections to transfer data to the displays. Only the connections to displays 74 and 84 are shown for the sake of clarity. Tabulate button 16 is pressed once to display statistics from the previous set and pressed additional times to review earlier sets. If tabulate button 16 is held down for 5 seconds, for example, the cumulative totals of all stored sets will be displayed. Additional digits may be added to the displays to show large cumulative totals.

If one of the push-buttons 30, 40, 50, 60, 70 or 80 is mistakenly depressed, the entry or entries may be corrected by using push-button 18. Push-button 18 is a latch switch which toggles the push-button connection between the plus (+) input and the minus (−) input of the respective counter. A player intending to press push-button 70 for unforced errors, might have mistakenly pressed push-button 40 and then 60. To correct the errors, push-button 18 would be depressed, coupling all push-buttons to the minus (−) input on the corresponding counters. Push-buttons 40 and 60 would be depressed to reduce the value in counters 42 and 62 by the one mistaken entry. The minus (−) inputs include an electronic override whereby holding down any one of the push buttons for five seconds would reset the counter to zero. Push-button 18 would be depressed again, returning the latch switches to the plus (+) input position on the counters as shown in FIG. 2. Push-button 70 could then be depressed to increment the proper category. Clear button 18 may include an electronic override whereby holding down clear button 18 for five seconds resets all of the counters.

The six categories serve valuable teaching functions by tracking different categories of lost points. A player using the statistical recording device according to the invention will be able to determine which category they lose the most points in. For example, a player might determine that against a particular opponent they lose a high number of points to aces, indicating that practice is needed in returning serves. Alternatively, they might find that on certain courts, they have a high number of unforced errors indicating that another strategy should be followed. Advanced versions could include additional categories or subcategories to more accurately track a player's game. For example, forehand winners, backhand winners, forehand volley winners, back-hand volley winners, unforced forehand errors, unforced backhand errors, unforced forehand volley errors, unforced backhand volley errors, forced forehand errors, forced back-hand errors, forced forehand volley errors, and forced back-hand volley errors.

The device may also time the length of a game and incorporate other time keeping functions which are disclosed in U.S. Pat. Nos. 4,237,372 and 5,134,565, the contents of which are incorporated herein by reference thereto. For example, in other modes the device provides a clock, date, day of the week, stop watch and alarm functions. Operation of the clock or stop watch may be provided simultaneously with operation in the statistical recording mode, the time-keeping function being displayed in another region of display area 22. Accordingly, the player will know when they have played until a certain time (6 p.m.) or how long they have played for (2 hours). In a further embodiment, the device tracks permitted times for delays in tennis (30 seconds from the end of a volley to the next serve), providing an audible beep at the expiration of the permitted delay.

It will be seen that we have achieved the objects of our invention. We have provided a device that indicates specifically how points are won, or lost, in at least six different categories, which data cannot be inferred from the game score. The device may be embodied in a wristwatch, thereby providing a lightweight and conveniently accessible device which will not interfere with the game. The device may be used by coaches and players of any level. The device may store the reported data for subsequent downloading for archiving and other historical statistical analysis. The point tracking operation may be combined with various time-keeping functions.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. An apparatus for analyzing a player's tennis game including in combination:

means for tracking statistics within six different categories;

six counters, each providing an output;

means responsive to said statistics tracking means for increasing the output of a corresponding counter by one count;

means for visually displaying the output of each counter;

means for summing the outputs of said counters to provide a summed output; and means for visually displaying the summed output.

2. The apparatus of claim 1, wherein said statistics tracking means comprises one push-button for each category.

3. The apparatus of claim 2, further comprising means responsive to each depression of a push-button for decreasing the output of a corresponding counter by one count.

4. The apparatus of claim 3, additionally comprising means for selectively coupling said push-buttons to said increasing means and said decreasing means.

5. The apparatus of claim 4, wherein said selective coupling means comprises a six-pole latch switch.

6. The apparatus of claim 4, wherein said increasing means comprises a counter input for increasing the value within the counter.

7. The apparatus of claim 4, wherein said decreasing means comprises a counter input for decreasing the value within the counter.

8. The apparatus of claim 1, including a time-keeping system comprising means for tracking and displaying a time of day.

9. The apparatus of claim 8, wherein the time of day is selectively displayed with the counter outputs and the summed output.

10. The apparatus of claim 1, including a time-keeping system comprising means for tracking and displaying a day and date.

11. The apparatus of claim 1, including a time-keeping system comprising means for tracking and displaying permitted times for delays of a tennis match.

12. The apparatus of claim 11, wherein said time-keeping system provides an indication upon expiration of the permitted time for delay.

13. The apparatus of claim 1, comprising a storage device, and means for applying said counter outputs to said storage device for retention.

14. The apparatus as in claim 13, wherein said storage device includes non-volatile memory.

15. The apparatus as in claim 14, including means for transmitting the retained counter outputs out of said non-volatile memory.

16. The apparatus as in claim 1, wherein said means for visually displaying the output of each counter comprises an LCD display area corresponding to each counter.

17. The apparatus as in claim 1, wherein said means for visually displaying the summed output comprises a further LCD display area.

18. The apparatus as in claim 1, wherein three of said categories track three different types of winning points.

19. The apparatus as in claim 1, wherein three of said categories track three different types of losing points.

* * * * *